United States Patent [19]

MacMillan

[11] Patent Number: 4,765,611

[45] Date of Patent: Aug. 23, 1988

[54] APPARATUS AND METHOD FOR WEIGHT TRAINING EMPLOYING COUNTERWEIGHT

[75] Inventor: Michael MacMillan, Springfield, Ill.

[73] Assignee: University of Florida, Gainesville, Fla.

[21] Appl. No.: 921,763

[22] Filed: Oct. 22, 1986

[51] Int. Cl.[4] ..... A63B 21/06

[52] U.S. Cl. ..... 272/118; 272/123; 272/130

[58] Field of Search ..... 272/118, 117, 123, 130

[56] References Cited

U.S. PATENT DOCUMENTS 4,249,726 2/1981 Faust .
4,349,192 9/1982 Lambert, Jr. et al. .
4,373,717 2/1983 Lambert, Jr. .
4,471,956 9/1984 Marlo .
4,505,475 3/1985 Olschansky et al. .
4,540,171 9/1985 Clark et al. .
4,546,971 10/1985 Raasoch .
4,563,003 1/1986 Bugallo et al. .

*Primary Examiner*—Carl D. Friedman
*Attorney, Agent, or Firm*—Dennis P. Clarke

[57] ABSTRACT

A weight training apparatus and method using a primary weight and a secondary weight, said apparatus enabling repeated negative resistance phases of a series of two-phase weight training cycles to be performed using only the primary weight, said apparatus enabling the positive resistance phases of the weight training cycles to be performed with the assistance of the secondary weight acting as a counterweight.

27 Claims, 4 Drawing Sheets

APPARATUS AND METHOD FOR WEIGHT TRAINING EMPLOYING COUNTERWEIGHT

BACKGROUND OF THE INVENTION

1. Field of the Invention

This invention relates to exercise machines used in weight training. Additionally this invention relates to a method of weight training which would require an apparatus as disclosed in the present invention.

2. Description of Related Art

The practice of lifting weights as a way to improve physical conditioning of the muscles has become increasingly popular in recent years. Although the methods for carrying out this practice vary widely, the basic principle involved is use of a muscle or muscle group to raise and lower weight against the force of gravity. With existing exercise equipment of the "constant resistance" type, the user raises and lowers a preselected weight.

It has been recognized in the art that the capability of a muscle to do work varies within the range of motion of that muscle. "Variable resistance" exercise equipment has been used to provide a potentially more efficient exercise of the muscle. In this type of equipment, a preselected weight is raised and lowered as the exercise is performed. A change in resistance occurs within the range of motion of the exercise through leverage changes, typically provided by cams built into the apparatus.

Other devices are known which assist the user of the equipment in raising a weight when the user can no longer perform the exercise. These devices may generally be reset after the user has completed the exercise.

SUMMARY OF THE INVENTION

Common experience, as well as medical research, has shown that human muscle, without assistance, is capable of lowering much heavier weights than can be raised. This common experience is typified by a bicep curl exercise. An average male holding a 50-pound dumbbell with his arm hanging straight down is unlikely to be able to curl it, that is, raise the weight against gravity by flexing his arm at the elbow. That same average male starting with the same 50-pound dumbbell raised in his hand with his arm flexed at the elbow would be able to slowly lower the weight against gravity.

The physiological explanation for this is found in the muscle activity involved. There are three types of muscular contraction: concentric, eccentric, and isometric. The isometric contraction, while arguably important to overall muscle conditioning, occurs when the muscle contracts against a fixed object with no raising or lowering motion occurring and is therefore not generally related to weight training.

The concentric contraction begins with the muscle lengthened and the contraction causes a shortening of the muscle. This is the type of contraction required in the bicep curl mentioned above where the male starts with the weight and his arm straight down at his side. The raising of a weight using a concentric contraction is called "positive resistance". The eccentric contraction begins with the muscle shortened. A force tending to lengthen the muscle, e.g., lowering a weight, does in fact increase the length of the muscle. However, the muscle is actually contracting in a physiological sense. This corresponds to, in the bicep curl example, starting with the weight raised and the arm flexed at the elbow. The lowering of a weight by an eccentric muscle contraction is called "negative resistance".

It has been found that any given muscle group can lower 10%–50% more weight through eccentric contraction, or negative resistance, than it can raise through concentric contraction, or positive resistance. It is therefore desirable in many instances to perform weight training exercises which employ a maximized negative resistance. It is only then that the muscle is exercised at its strength limit. Because a weight usually must be raised before it is lowered, the muscle does not normally encounter this maximized negative resistance. A weight training exercise employing maximized negative resistance provides strong stimulus for muscle growth and strength improvement.

The constant resistance equipment, including free weights (barbells and dumbbells), and variable resistance equipment previously mentioned as known in the art, do not allow a user to obtain this maximized negative resistance training.

The present invention provides a very effective weight training cycle to the user as it allows him to lower a greater weight than he must subsequently raise. The user may select a primary weight from a first set of weights which will provide suitable resistance for the negative resistance phase, or lowering motion. The user may also select an appropriate weight from a second set of weights which will act as a counterweight to the primary weight during the positive resistance phase of the cycle, or the raising motion. The user will thus be able to set the weights to provide an appropriate resistance for both the negative and positive resistance phases of the weight training cycle.

Also important in muscle development through weight training is the ability to continuously repeat the cycle of raising and lowering weight. These are called repetitions or simply "reps". The present invention provides the capability to do these "reps" with the alternating heavier and lighter weights, as many times as the user wishes to or is able to do so, without requiring him to leave his position at or on the apparatus.

It is an important object of the present invention to provide an exercise apparatus which allows the user to select an appropriate primary weight for one phase of a weight training cycle, and a second weight for use as a counterweight for the other phase of the weight training cycle.

It is another important object to provide an exercise apparatus which allows repetitive, consecutive, and continuous weight training cycles wherein the counterweight operates only during one phase of the cycle.

It is another object of the invention to provide an exercise apparatus which is capable of providing maximum tolerable resistance during both the raising and lowering phases of a weightlifting exercise.

It is another object of the invention to provide an apparatus which, in addition to being capable of providing maximum resistance during both phases of the exercise, may also be used as a conventional apparatus with no counterweight.

It is another object of the invention to provide an apparatus which may be used for negative resistance training only, if desired, by selecting a counterweight equal to the primary weight to be employed during the positive resistance phase only.

It is another important object of the invention to provide a method for weight training whereby a maximum tolerable resistance is encountered in both the positive and negative resistance phases, thereby providing a highly efficient exercise.

It is another important object of the invention to provide a method for weight training whereby the apparatus will perform certain of the steps, thereby allowing the exerciser to perform repeated, continuous, and consecutive exercise cycles. The ensuing description of the drawings and the appended drawings will make clear how the foregoing objects are achieved.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention taken in conjunction with the accompanying drawings wherein like reference characters represent like parts throughout the several views, wherein.

DETAILED DESCRIPTION OF THE DRAWINGS

Figure 1:
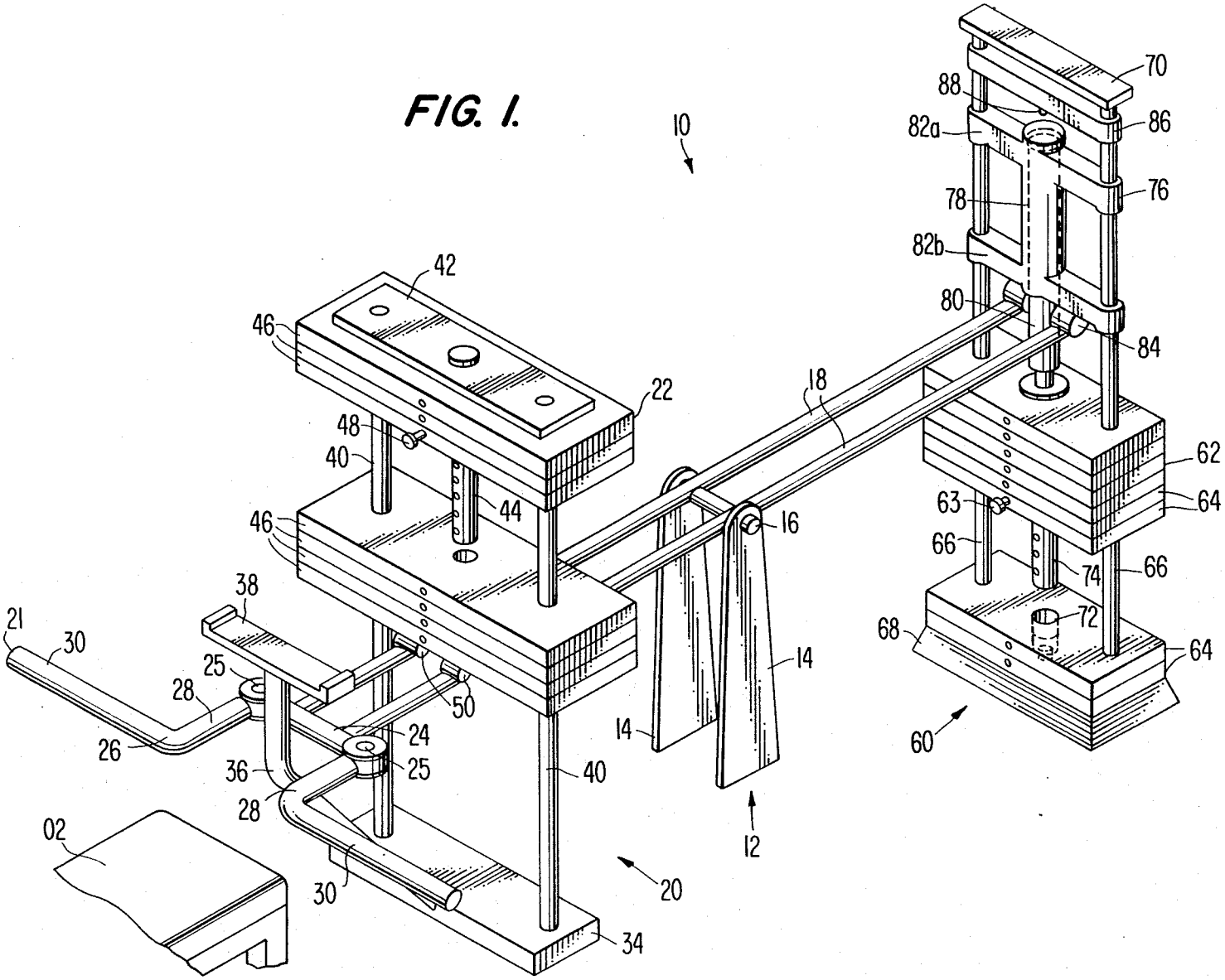
FIG. 1 is a perspective view of a weight training apparatus according to a preferred embodiment of the present invention, this preferred embodiment being configured for bench press exercises.

Referring to the drawings now wherein like reference numerals refer to like parts throughout the several drawings, reference numeral 10 is directed to the weight training apparatus according to the present invention. In this preferred embodiment the apparatus 10 is configured for use in performing bench press exercises. A fulcrum member 12 comprising two parallel, upright supports 14, has a pin 16 pivotably mounted at an upper portion between the supports. The fulcrum member 12 divides the apparatus into a primary, or operator, side 20 and a secondary side 60. Attached to a pivot pin 16 and extending axially between a primary set of weights 22 and a secondary set of weights 62, is weight bearing means 18 which is a component of operating member 21. In this embodiment, the weight bearing means 18 comprises two long parallel steel rods which interact with the weights during the weight training cycle. The fulcrum 12 is disposed midway between the two sets of weights. The pin 16 is attached to the weight bearing means 18 at a midpoint between the two sets of weights thus providing lever arms of equal length to each set of weights.

On the primary side 20 of the apparatus, the weight bearing means 18 terminates at, and in this embodiment is connected to the remainder of operating member 21, a transverse steel crossbar 24 and two L-shaped members 26 each having an axial section 28 and a transverse section 30. The transverse sections 30 of the two L-shaped members 26 serve as the grips for use in performance of the exercise. The L-shaped members 26 are attached to crossbar 24 by hinge joints 25 which allow the L-shaped members 26 to pivot inwardly toward each other from their normal exercise position. The weight rack section on the primary side includes a floor-mounted bracket 34 which has an upwardly and outwardly extending pipe 36 which supports bar rest 38. The bar rest is disposed so that when the operating member 21 is raised above it, L-shaped members 26 may be pivoted inwardly to engage the bar rest and be supported thereby. This will be the starting position for the exercise on this apparatus.

The primary weight support frame is attached to bracket 34 as well. Two spaced apart cylindrical guide rods 40 extend vertically upwardly from the bracket 34 and have a horizontally disposed upper brace 42 attached between the upper ends of the guide rods 40. Upper brace 42 also has a primary weight selection rod 44 attached and extending vertically downward therefrom.

The primary set of weights 22 is preferably a plurality of identical rectangular metal plates 46 which are stacked on top of each other. These plates 46 have three vertically oriented holes which correspond to the spacings and sizes of the two guide rods 40 and the weight selection rod 44 so that the plates may be raised and lowered being guided by the rods. Each of the plates 46 also has a horizontally and axially oriented hole. The primary weight selection rod 44 is provided with holes which have substantially the same spacing as the horizontal holes in the stack of metal plates 46. Thus, when the primary set of weights 22 is in the starting position (not shown) with all of the weight plates raised and stacked together, the plate holes will be aligned with the holes in the rod. This starting position is rather unique in an apparatus of this type in that the first exercise motion is a lowering of the weight.

A retaining pin 48 is provided for use in selecting a primary weight for the weight training cycle. The pin is to be inserted through substantially the entire width of a weight plate. It can be seen in FIG. 1 that the pin 48 will allow only those plates below the pin to be lowered during the weight training cycle. If the pin is not used, the exercise will be performed with the entire primary set of weights 22. The lower most weight plate rests on a pair of rollers 50, or alternatively a pair of pads, which in turn rest on weight bearing means 18. As the selected primary weight is raised and lowered, the weight plates are restricted to exclusively vertical movement by guide rods 40. Bench 02 is provided to allow the user to position himself to perform the weight training cycles.

On the secondary side 60 of the apparatus a more conventional floor-supported set of weights 62 with retaining pin 63 is provided. The metal plates 64 are similar in design to the primary metal plates, although they may be smaller or larger, providing a different weight increment. Vertical guide rods 66 are attached to base plate 68, and extend upward and terminate at cross member 70. Base plate 68 also houses an exhaust contact switch 72 which is disposed directly beneath secondary weight selection rod 74. Weight selection rod 74 will come in to contact with exhaust switch 72 upon reaching its downward extent of travel.

Counterweight positioning means 76 is slideably mounted on vertical guide rods 66 in this preferred embodiment. The positioning means comprise a hydraulic cylinder 78, an associated hydraulic piston 80, upper and lower guide arms **82*a*, 82*b*, rollers 84, and a cylinder pressurizing source (not shown). Piston 80 extends downwardly and is attached to, or can be integral with, secondary weight selection rod 74. The rollers 84 of counterweight positioning means 76 rest on the secondary end 18***b* of weight bearing means 18. Counterweight positioning means 76 will effortlessly follow both the upward and downward vertical displacement of secondary end 18*b*. Positioned above, and also slideably mounted on guide rods 66, is pressurizing contact switch support arm 86, which holds pressurizing contact switch 88 in a position directly above hydraulic cylinder 78.

The hydraulic cylinder 78 is configured so that when pressurized, the piston 80 is retracted into and retained in the cylinder, and when unpressurized the piston 80 will be free to travel in and out of the cylinder 78. Pressurizing switch 88 is designed to cause the cylinder to be pressurized when contacted and remain pressurized until exhaust switch 72 is contacted. Likewise, exhaust switch 72 is designed to depressurize the cylinder and allow free movement of the piston until the cylinder is pressurized again by contacting pressurizing switch 88. Thus in this embodiment, a means for activating the counterweight positioning means is provided in the form of pressurizing switch 88, and a means for deactivating the counterweight positioning means is provided in the form of exhaust switch 72.

Specific details of the hydraulic circuit are omitted from the drawings as components of this type are well known in the art. Those of ordinary skill in the art will readily recognize which specific components will be suitable for this service. For example, the pressurizing source may be an air compressor, or an air tank, or even possibly a closed liquid circuit with a pump.

Figure 2A:
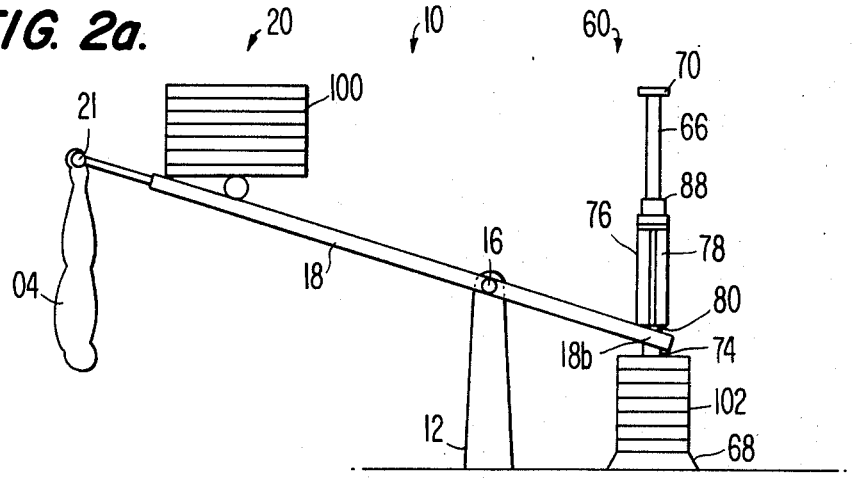
FIGS. 2*a–d* are side views of the bench press apparatus showing positions of weights and counterweights in various phases of a weight training cycle.
Figure 2B:
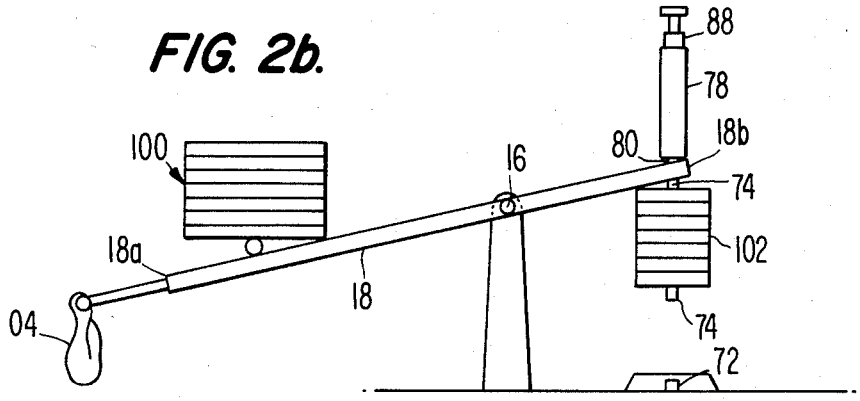
Figure 2C:
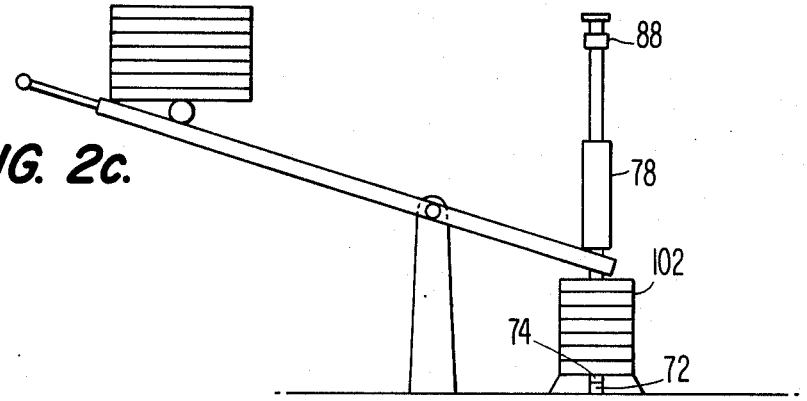
Figure 2D:
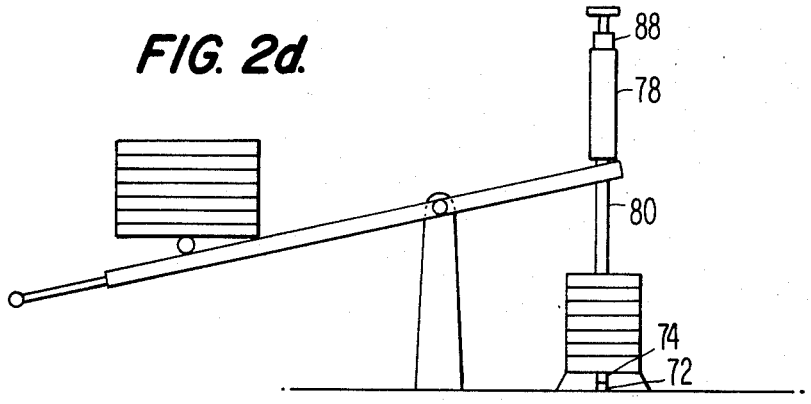

The sequence of operation of the weight training apparatus 10 according to the present invention can best be seen in FIGS. 2*a–d*. Portions of the apparatus 10 have been omitted and other portions are represented in block figure form for ease in describing the principles of operation. FIGS. 2*a* and 2*b* show the starting position of the apparatus and the completion of the initial negative resistance phase of a weight training cycle respectively. FIG. 2*c* shows the apparatus at the completion of the initial and subsequent positive resistance phases. FIG. 2*d* shows the end position of the subsequent negative resistance phases.

The main objective of the initial cycle is to set the height of pressurizing switch 88 on the secondary side 60 to correspond to the desired range of exercise motion on the primary side 20 for the negative resistance phase of the cycle. If this range can be predetermined by, e.g., familiarity with the equipment, then the height may be manually set by sliding the switch on the guide rods before starting, in which case, the starting position would be same for the initial cycle as well as the subsequent cycles (see FIG. 2*c*).

Referring now to FIG. 2*a*, at the start of the exercise a desired primary weight 100 is selected at primary side 20, and a secondary weight 102 is selected at secondary side 60. The user, represented by arm 04, lies in a supine position on bench 02 (FIG. 1) and reaches up to grasp operating member 21, which, as described previously, will be supported on the bar rest 38 (FIG. 1). The user then pushes up slightly on operating member 21 and pivots L-shaped members 26 (FIG. 1) outwardly to their exercise position.

The secondary weight 102, the secondary end of weight bearing means 18*b* and the counterbalance positioning means 76 will all be at their lowest positions by virtue of weight bearing means 18 being a straight rigid member which, when cooperating with pivot pin 16 and fulcrum 12, resembles a seesaw configuration. Pressurizing switch 88 should be manually positioned at its lowest point as well, that is, in contact with the top of cylinder 78.

Moving to FIG. 2*b*, the primary weight 100 and the primary end 18*a* of weight bearing means 18 are lowered by the user 04, and weight bearing means 18 pivots at pivot pin 16 causing its secondary end 18*b* to be raised. The secondary end 18*b* engages and raises positioning means 76 (FIG. 1). Because cylinder 78 has contacted pressurizing switch 88, the activating means for counterweight positioning means 76, cylinder 78 is pressurized, and the piston 80 stays in its retracted position. The piston 80 which is connected to weight selection rod 74 thus causes secondary weight 102 to be raised as well. The secondary weight is thus acting as a counterweight and the effective weight being lowered is the difference between the primary and secondary weights. Once the user 04 has reached a desired lower extent of travel for this negative resistance phase, he will begin the first positive resistance phase by exerting upward force, and the apparatus will move from the FIG. 2*b* position to the FIG. 2*c* position. The pressurizing switch 88 will remain in the upper position corresponding to the desired lower extent of travel on the primary side 20. This can be accomplished in one way by providing a mild interference fit between openings in the switch support arm 86 and guide rods 66 (FIG. 1) which allow the arm to slide upwardly when urged by the force of the weight bearing means 18, but not downwardly merely from its own weight.

As seen in FIG. 2*c*, the lower tip of secondary weight selection rod 74 contacts the exhaust switch 72, which is the deactivating means for counterweight positioning means 76 and causes the cylinder 78 to be depressurized. This allows the second (and all subsequent) negative resistance phases of the cycle to be performed without the secondary weight acting as a counterweight. As the primary weight is lowered from the FIG. 2*c* position to the FIG. 2*d* position, the piston 80 merely slides out of the now unpressurized cylinder 78, leaving the secondary weight 102 at rest on the base plate. Thus, a negative resistance phase is performed with the maximum desired weight (selected as the primary weight 100).

As the user reaches the already determined lower extent of travel, positioning means 76 (FIG. 1), and namely the top of the cylinder 78, contacts the means for activating counterweight positioning means 76, pressurizing switch 88. The cylinder is then pressurized, drawing the piston 80 and attached secondary weight 102 into a position (see FIG. 2*b*) to act as a counterweight during the positive resistance phase of the weight training cycle. Thus, the user must pause only momentarily between these phases to allow the secondary weight to be positioned and may repeat the FIG. 2*b* through 2*d* sequence as many times as desired. He will be lowering a greater primary weight 100 during the negative resistance phases and raising a lesser effective (primary minus secondary) weight during the positive resistance phases.

Figures 3, 5:
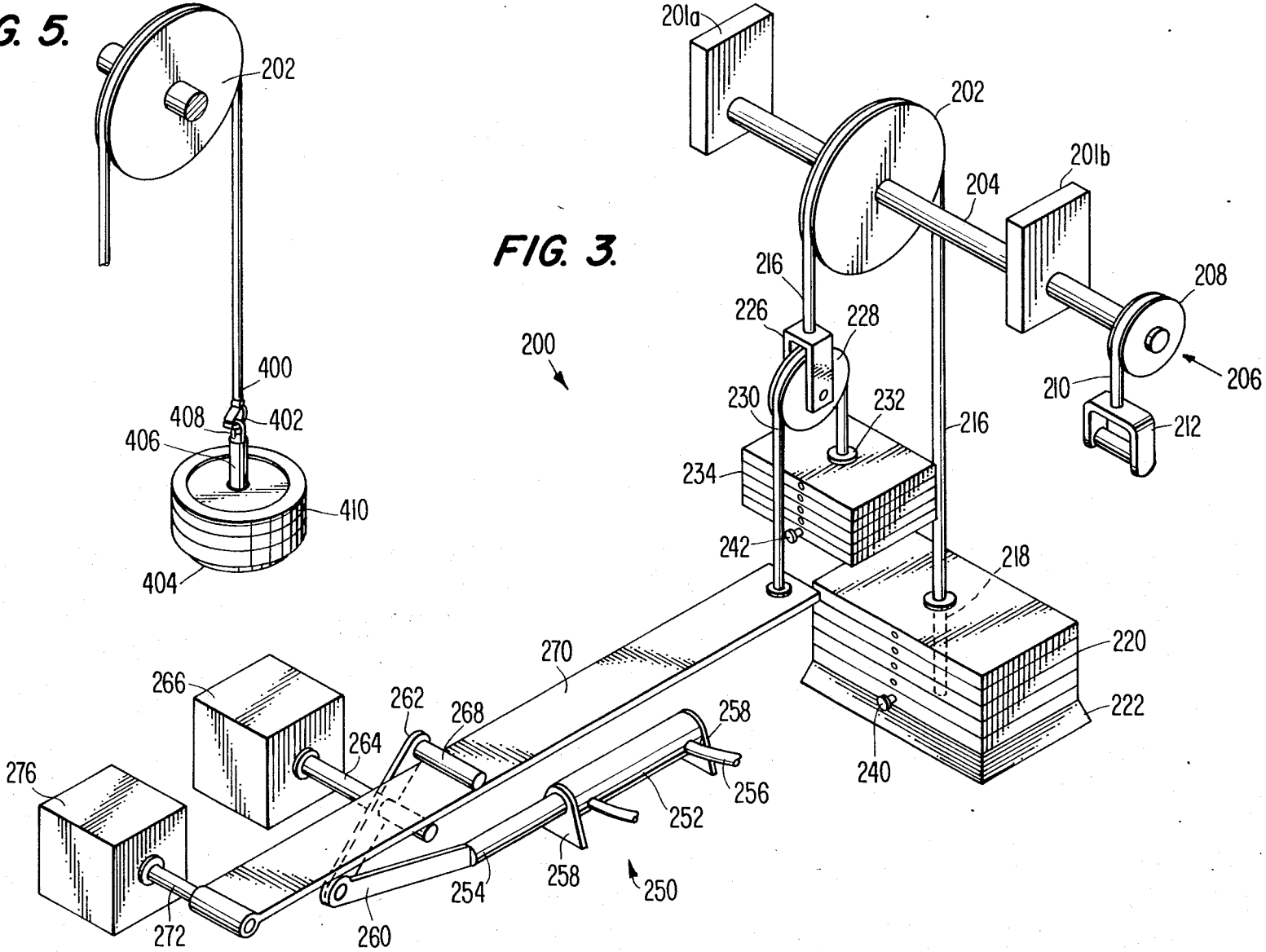
FIG. 3 is a perspective view of another preferred embodiment of the present invention.
FIG. 5 shows an alternate set of weights.

An alternative embodiment is also shown in FIGS. 3 and 4*a–c*. This embodiment employs pulleys and can be more readily adapted for use with machines on which the exercise is not primarily a vertical lift, such as bicep or tricep exercises. In FIG. 3 the apparatus 200 of the alternate embodiment is shown in perspective view. Primary pulley 202 and primary pulley axle 204 are held in fixed horizontal and vertical position by frame members 201*a*, 201*b* (only partially shown). It should be understood that these frame members may be extended downwardly to be attached to the floor, upwardly to a ceiling or to a wall at the front or rear of the apparatus 200. Primary pulley axle 204 extends through one of the frame members, here shown as 201*b*, and attaches to an operating member 206. In this drawing operating member 206 is depicted as a drive pulley 208 with cable 210 and grip 212 attached. It is to be appreciated that the operating member can be something other than a pulley, such as a curl bar, which is well known in the art, an example of which is depicted in U.S. Pat. No. 4,239,210, herein incorporated by reference.

Primary pulley cable 216 is connected at one end to a primary weight selection rod 218 which extends through a primary set of weights 220 much like the configuration of the secondary set of weights in the previous embodiment. Vertical guide rods for the weights (not shown) may be used, but are not generally required by this embodiment. Primary base plate 222 is attached to the ground and houses pressurizing contact switch 224 (FIG. 4) disposed for contacting the lower tip of primary weight selection rod 218 when that set of weights is lowered completely. At its other end, primary pulley cable 216 is attached to a secondary pulley housing 226. Secondary pulley housing 226 rotatably holds secondary pulley 228. Secondary pulley cable 230 is attached on one end to secondary weight selection rod 232, which extends through secondary set of weight 234 in a similar fashion to the primary set of weights 220. A secondary base plate 236 (FIG. 4) is also provided, and houses exhaust contact switch 238 (FIG. 4). Retaining pins 240, 242 are provided to allow selection of a desired primary weight and secondary weight (counterweight) for the weight training cycle.

The counterweight positioning means 250 in this embodiment of the invention also uses a hydraulic cylinder 252, with piston arm 254, connected to a pressurizing source (not shown) by hose 256. The cylinder 252 is fixed in place by mounts 258 attached to the floor. Piston 254 has an extension 260 which is pivotably connected at its farthest end to an end of lever 262. Lever 262 has a centrally disposed pivot axle 264 extending horizontally through the lever, and connected to a ground support block 266 at one end which allows the axle to rotate but not move otherwise. At the end of the lever 262 opposite that of the piston 254 connection is a pinch rod 268 extending out parallel to the unconnected end of the pivot axle 264.

Counterweight positioning bar 270 is held by a horizontal pivot rod 272 at one end, pivot rod 272 being mounted to block 276. The counterweight positioning bar 270 extends from pivot rod 272, between pivot axle 264 and pinch rod 268, and terminates at a connection point where it is attached to the second end of the secondary pulley cable 230.

Figure 4A:
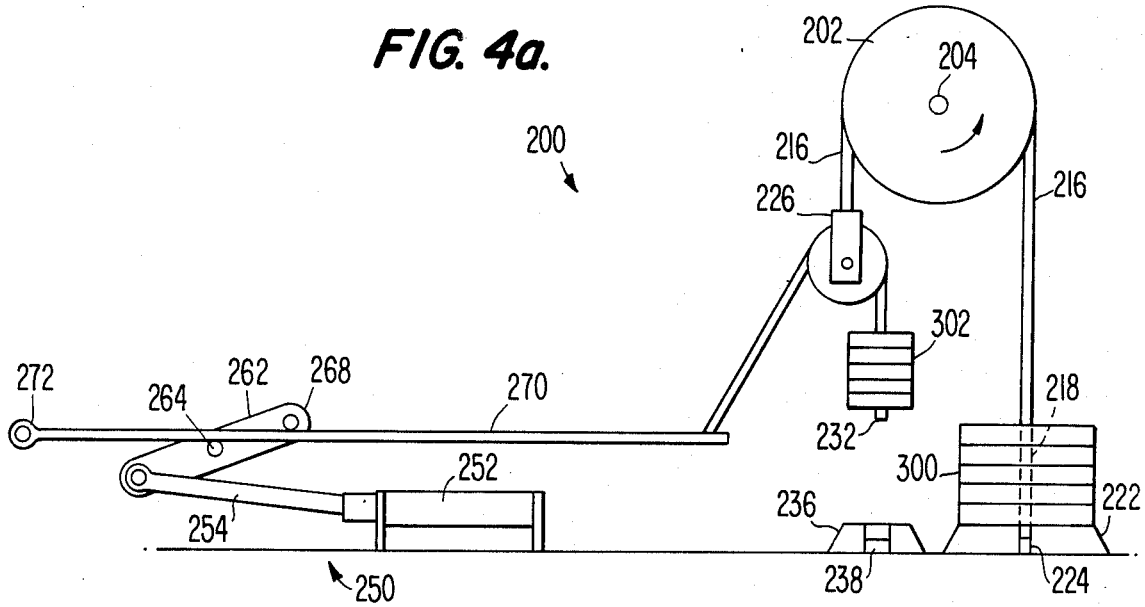
FIGS. 4*a–c* are side views of the alternate embodiment showing positions of the apparatus in various phases of the exercise.
Figure 4B:
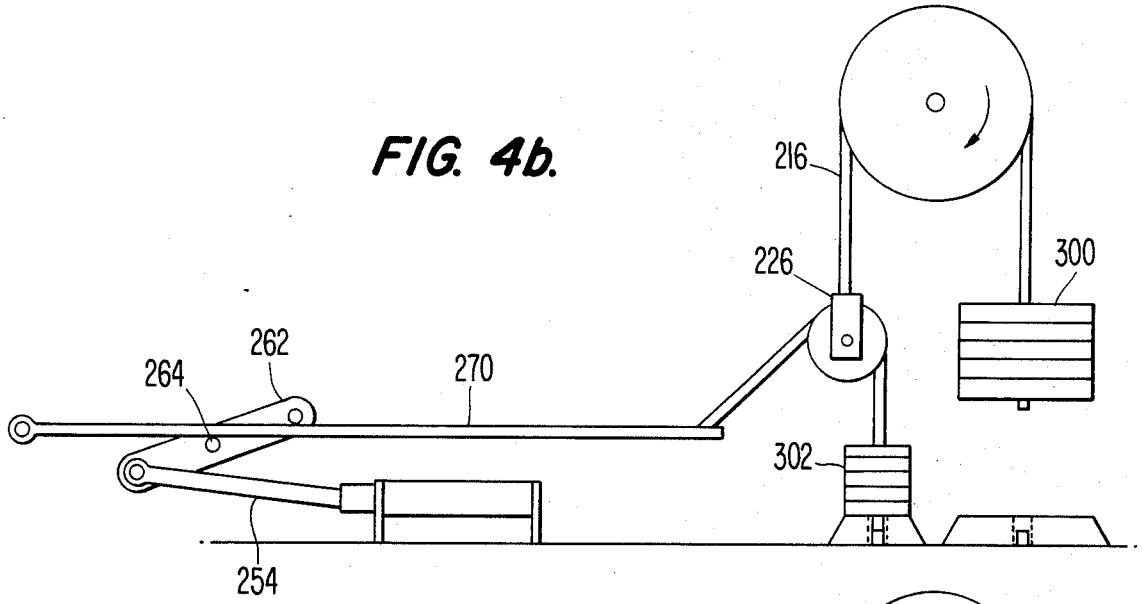
Figure 4C:
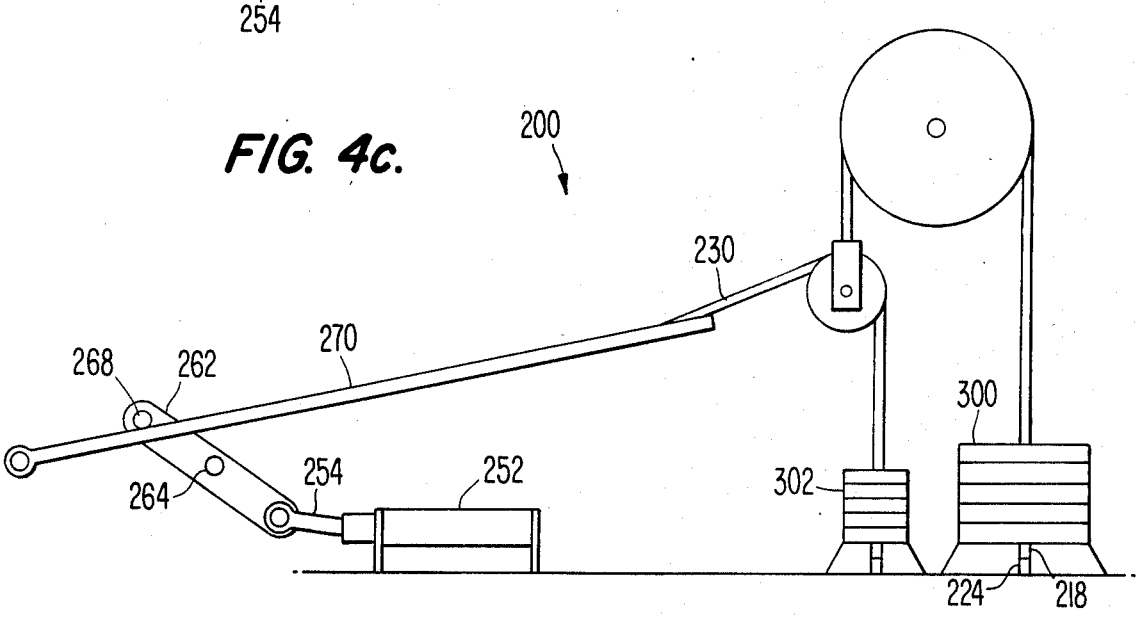

The sequence of operation of the invention in this embodiment is best shown in FIGS. 4*a*–*c*. FIG. 4*a* shows the position of the apparatus 200 ready to perform a positive resistance phase of a weight training cycle. The cylinder and contact switches operate in a slightly different manner than the other embodiment described. In the FIG. 4*a* position the pressurizing switch 224 has been contacted, and the cylinder 252 has been pressurized to push the piston 254 outwardly and hold it in that position. This locks lever 262 into the position shown. Pinch rod 268 thus is holding counterweight positioning bar 270 in a lowered position (substantially horizonal) which in turn is holding the selected secondary weight 302 in a raised position to act as a counterweight.

The positive resistance phase requires a raising of a selected primary weight 300, thus force must be exerted on the operating member 208 (FIG. 3) to cause a rotation (counterclockwise in FIG. 4*a*) of primary axle 204 and pulley 202 which will raise primary weight 300. When the primary pulley 202 is rotated the user is assisted by the downwardly tending force exerted on the other end of primary cable 216 by the raised secondary weight 302. The length of primary cable 216 becomes shorter on the primary weight side and longer on the side attached to secondary pulley housing 226, lowering the secondary weight 302. The positive resistance phase is completed when secondary weight 302 touches down on secondary base plate 236 and the tip of secondary weight selection rod 232 contacts exhaust switch 238. This contact causes cylinder 252 to be depressurized, and deactivates counterweight positioning means 250.

The position shown in FIG. 4*b* is the position of the apparatus at the completion of this positive resistance phase, which is also the beginning point for the negative resistance phase of lowering the primary weight 300. When the user begins to lower the primary weight 300, the length of primary cable 216 will begin to be transferred back to the primary weight side. This will cause an upward pull by primary cable 216 on secondary cable housing 226, but because the cylinder has been depressurized, piston 254 will be allowed to freely retract, and housing 226 will pull counterweight positioning bar 270 upward instead of the secondary (counter) weight 302 itself. Lever 262 will pivot freely about pivot axle 264, and the apparatus 206 will move to the position as shown in FIG. 4*c*. It can be seen from this that the entire negative resistance cycle would be performed without the "benefit" of a counterweight.

FIG. 4*c* shows a position of the apparatus 200 at the completion of a negative resistance phase, which position is only temporary. When primary weight 300 reaches its lowest point (rest position), the tip of primary weight selection rod 218 contacts pressurizing switch 224, causing cylinder 252 to be pressurized, thus reactivating the counterweight positioning means. Piston 254 is forced outwardly, which in turn forces lever 262 to pivot about axle 264. When this occurs, pinch rod 268 is forced down upon counterweight positioning bar 270, and bar 270 pulls down on secondary pulley cable 230, raising secondary weight 302 back into position to act as a counterweight. It can be readily seen that the weight training cycle may be repeated in this fashion as many times as the user desires.

FIG. 5 shows a possible alternative to the primary or secondary set of weights depicted in the previous figures. It would be especially easily adapated to the embodiment using the pulley system and may be desirable where the exercise does not require a great deal of weight. The weight holding end of the cable 400 is provided with a heavy-duty clasp 402. A weight-holding flange 404 protrudes radially outwardly from weight pole 406 at its lower end. A hook 408 is provided at the upper end of pole 406. The weight selection is accomplished by sliding free weights 410 of various size and weight found commonly in the weight training art, over pole 406 to rest on flange 404 and subsequently connecting hook 408 to clasp 402 at the end of cable 400. The flange 404 would be provided with a nipple (not shown) on its lower side if the contact switch is countersunk into a base plate as it was in the previously described embodiments.

These embodiments of the present invention are also very versatile weight training devices. Although they have been described to this point as being used with a maximum negative and maximum positive resistance, they can be used in other ways. The secondary weight, or counterweight, may be selected to be the same weight as the primary weight, thus providing a weight training cycle with an effective weight of zero during the positive resistance phase if exclusively negative resistance training is desired.

Also, once the activating and deactivating means are set in place, a user may do several repetitions with only the primary weight by stopping his negative resistance phase before the activating means is contacted. Then, when his muscles begin to tire, he may lower the weight to its full extent, thereby contacting the activating means to have the counterweight raised into position. Other variations will be readily apparent to those of ordinary skill in the art.

Although specific constructions and features have been described in preferred embodiments, it is to be readily appreciated that these are for illustrative purposes only. Various changes and modifications will readily occur to those of ordinary skill in the art and, accordingly, the scope of the present invention should be determined by reference to the appended claims.

I claim:

1. A weight training apparatus comprising:

an operating member;

a primary set of weights connected to said operating member, said primary set adapted to be raised during a first phase of a two-phase weight training cycle and lowered during a second phase;

a secondary set of weights adapted to be intermittently positioned to perform as a counterweight;

means for positioning said secondary set of weights to counterbalance said primary set of weights;

means for activating said positioning means wherein said secondary set of weights is positioned for subsequent movement in a downward direction when said primary set of weights is raised in an upward direction during said first phase; and means for deactivating said positioning means, wherein said deactivating means is operable to preclude said secondary set of weights from counterbalancing said primary set of weights during said second phase.

2. The apparatus of claim 1 wherein said positioning means, said activating means, and said deactivating means are disposed to allow repeated performance of the two-phase weight training cycle, wherein said first phase is a positive resistance phase and said second phase is a negative resistance phase, said positioning means being activated at the beginning of said positive resistance phase, and said positioning means being deactivated at the beginning of said negative resistance phase.

3. The apparatus of claim 1 wherein said positioning means further comprises a hydraulic cylinder, a piston, and a pressurizing source.

4. The apparatus of claim 3 wherein said activating means comprises a first contact switch whereby, upon being contacted, said first contact switch causes said pressurizing source to pressurize said hydraulic cylinder.

5. The apparatus of claim 4 wherein said deactivating means comprises a second contact switch, whereby, upon being contacted, said second contact switch causes said hydraulic cylinder to be depressurized.

6. The apparatus of claim 1 wherein each of said primary and secondary set of weights further comprises means for selecting only a portion of said set to be employed during said exercise.

7. A weight training apparatus comprising:

an operating member;

a primary set of weights connected to said operating member, said primary set adapted to be raised during one phase of a two-phase weight training cycle and lowered during the other;

a secondary set of weights;

means for positioning said secondary set of weights to perform as a counterweight;

means for activating said positioning means; and means for deactivating said positioning means;

wherein said operating member comprises a straight, rigid weight bearing means and a grip means, said weight bearing means being attached at its axial midpoint to a transverse pivot pin, said pivot pin being held in place above the ground by a fulcrum member, said pivot pin and fulcrum member defining a boundary between a primary side and a secondary side of said apparatus, wherein said primary set of weights is disposed near a primary end of said weight bearing means and rests on said weight bearing means on said primary side, said grip means extending from said primary end, and wherein said secondary set of weights is disposed near a secondary end of said weight bearing means on said second side.

8. The apparatus of claim 7 wherein said positioning means is disposed above said secondary end of said weight bearing means and said secondary set of weights is disposed below said secondary end.

9. The apparatus of claim 8 wherein said positioning means comprises a hydraulic cylinder, a piston, and a pressurizing source, and said positioning means is slideably mounted on at least one vertical guide rod.

10. The apparatus of claim 9 wherein said cylinder is operable to allow said piston to extend substantially freely in a downward direction from said cylinder when said cylinder is unpressurized and said cylinder further being operable to retract and retain said piston when said cylinder is pressurized, said piston being attached to a secondary weight selection rod, and said secondary weight selection rod is disposed through a bore in said secondary set of weights.

11. The apparatus of claim 10 wherein said activating means comprises a first contact switch, said activating means being disposed above said positioning means, said activating means further being slideably mounted on at least one vertical guide rod, said activating means operable to cause said pressurizing source to pressurize said hydraulic cylinder when contacted.

12. The apparatus of claim 11 wherein said deactivating means comprises a second contact switch said deactivating means being disposed within a base plate beneath said secondary set of weights, said deactivating means operable to cause said cylinder to be depressurized when contacted.

13. A weight training apparatus for use in performing a weight training cycle having a positive resistance phase and a negative resistance phase, comprising:

a primary weight;

an operating member connected to said primary weight said operating member disposed to allow said primary weight to be raised and lowered when said operating member is raised and lowered;

a secondary weight;

means for raising said secondary weight to a position wherein said secondary weight is disposed to counterbalance said primary weight during said positive resistance phase;

means for activating said raising means; and means for deactivating said raising means.

14. The apparatus of claim 13 wherein said activating means is disposed to activate said raising means when said primary weight has been fully lowered by an exerciser and said deactivating means is disposed to deactivate said raising means when said primary weight has been fully raised by the exerciser, whereby said secondary weight will act as a counterbalance during only the positive resistance phase of said weight training cycle.

15. The apparatus of claim 13 wherein said raising means comprises a pressurizable hydraulic cylinder and piston, and said activating means and deactivating means each comprise a contact switch said activating means causing said cylinder to be pressurized and said deactivating means causing said cylinder to be depressurized, wherein said activating means and said deactivating means are disposed to be contacted by at least one moving part of said apparatus, said switches being disposed in a manner to be contacted in an alternating manner so that said weight training cycle may be continuously repeated.

16. The apparatus of claim 13 wherein each of said primary weight and said secondary weight further comprises a set of weights, each of said sets of weights having means for selecting a weight to be used in a weight training cycle.

17. A weight training apparatus comprising:

a primary weight;

an operating member connected to said primary weight to enable the primary weight to be repeatedly raised in a positive resistance phase and lowered in a negative resistance phase of repeated two phase weight training cycles;

means for counterbalancing said primary weight, said counterbalancing means operating to assist an exerciser in said repeated raisings of said primary weight; and means for precluding said counterbalancing means from operating to assist an exerciser in said repeated lowerings of said primary weight.

18. The apparatus of claim 17 wherein said counterbalancing means comprises means for repeatedly raising a secondary weight at the start of the positive resistance phases of the repeated two phase weight training cycles for use as a counterweight during said positive resistance phases.

19. The apparatus of claim 18 wherein said precluding means comprises means for disabling said raising means at the start of the negative resistance phases of said repeated two phase weight training cycle.

20. The apparatus of claim 19 wherein said raising means comprises a hydraulic cylinder, a piston attached to said secondary weight, a pressurizing source for said cylinder and means for activating said raising means, said activating means causing said pressurizing source to pressurize said cylinder.

21. The apparatus of claim 20 wherein said activating means comprises a first contact switch, and said disabling means comprises a second contact switch, said second contact switch causing the cylinder to depressurize when said switch is contacted.

22. A method for performing weight training exercises comprising:

(a) selecting a primary weight on an apparatus for resistance in a negative resistance phase of said weight training exercise;

(b) selecting a secondary weight on said apparatus for counterbalancing said primary weight in a positive resistance phase of said weight training cycle;

(c) engaging an operating member connected to said primary weight;

(d) lowering said primary weight in a first negative resistance phase;

(e) activating a positioning means to raise said secondary weight, said secondary weight thereby being capable of performing as a counterbalance;

(f) raising said primary weight in a first positive resistance phase, said secondary weight performing as a counterbalance;

(g) deactivating said positioning means to allow a second and subsequent repeated negative resistance phases using only said primary weight (h) activating said positioning means at the start of each ensuing positive resistance phase.

23. The method of claim 22 wherein said positioning means comprises a hydraulic cylinder, piston pressurizing source, and a first contact switch, and said activating of said positioning means comprises completing the full range of lowering motion to enable a desiganted moving part of said apparatus to touch said first contact switch, said first contact switch causing said cylinder to be pressurized.

24. The method of claim 23 wherein said deactivating of said positioning means comprises completing the full range of raising motion to enable a designated moving part of said apparatus to touch a second contact switch, said second contact switch causing said cylinder to be depressurized.

25. A method for performing weight training exercises using an apparatus designed to provide a positive resistance phase and a negative resistance phase in each weight training cycle comprising:

(a) selecting a primary weight;

(b) selecting a secondary weight for use as an intermittent counterbalance;

(c) lowering said primary weight in said negative resistance phase without the assistance of the counterbalance;

(d) engaging and raising said counterbalance;

(e) raising said primary weight with the assistance of the counterbalance during said positive resistance phase;

(f) disengaging said counterbalance;

(g) repeating steps (c)–(f).

26. The method of claim 25 wherein said engaging and raising of the counterbalance are performed by the apparatus.

27. The method of claim 25 wherein said secondary weight comes to rest on the ground at the end of said positive resistance phase and said disengaging is performed by the apparatus.

* * * * *